United States Patent [19]

Lobe

[11] Patent Number: 4,846,745

[45] Date of Patent: Jul. 11, 1989

[54] SAILBOARD FIN RETAINING MEMBER

[76] Inventor: Henry J. Lobe, 100 Archwood Ave., Annapolis, Md. 21401

[21] Appl. No.: 146,612

[22] Filed: Jan. 20, 1988

[51] Int. Cl.[4] ..... A63C 15/05

[52] U.S. Cl. ..... 441/79; 114/132

[58] Field of Search ..... 403/2; 114/39.2, 127, 114/132, 140; 441/79, 74

[56] References Cited

U.S. PATENT DOCUMENTS 3,846,030 11/1974 Katt ..... 403/2
4,052,826 10/1977 Chisholm ..... 403/2
4,398,485 8/1983 Diziere ..... 441/79
4,528,924 7/1985 Marker et al. ..... 114/39.2
4,701,144 10/1987 Dewitt, III ..... 441/79

FOREIGN PATENT DOCUMENTS 2510968 2/1983 France ..... 441/79

*Primary Examiner*—Sherman D. Basinger
*Attorney, Agent, or Firm*—Fendall Marbury

[57] ABSTRACT

A method of attaching a fin to an adjustable fin holder of a surfboard or sailboard that protects the fin, fin holder and board structure around the fin holder from damage if the fin strikes an under water object.

8 Claims, 2 Drawing Sheets

SAILBOARD FIN RETAINING MEMBER

PRIOR ART

The adjustable fin holder to which the present invention applies, which is used in most sail and surfboards, differs only in detail from that of U.S. Pat. No. 3,564,632, by W. L. Bahne, Jr., for ADJUSTABLE SURFBOARD FIN HOLDER, which is incorporated by reference herein. This patent explains why an adjustable holder is desirable.

Present practice differs from Bahne in only two respects: The interior sidewalls of Bahne's elongated channel, which converge, and the mating surfaces of Bahne's fin positioning tongue, which form a matching wedge, have both become parallelsided. As a result, when the fin is drawn into the channel by a bolt, it is clamped against the bottom of the channel, instead of being wedged against the sides. In present practice, the sides of the channel continue to give the fin lateral support.

The clamping means is as shown by Bahne, but today there is only one of them, on the forward end of the fin base. (The rear end is not clamped, but is retained in the channel as described below.) The present invention has to do with this clamping means, especially with Bahne's "retaining plate".

U.S. Pat. No. 4,398,485 by Bernard Diziere for DEVICE FOR DETACHABLY SECURING A CENTERBOARD TO A SAILBOARD OR THE LIKE has the same main object as the present invention, to protect the fin and sailboard from damage when the fin hits something. Diziere is cited as evidence of long-felt need for this type of protection. Diziere completely replaces the standard Bahne-like adjustable fin holder with an incompatible and non-adjustable fin holder. Unlike Diziere, the present invention has the advantages that it can be readily applied to the very many existing surf and sailboards, and that it retains the advantage of adjustability.

BACKGROUND OF THE INVENTION

Sailboarding since its introduction in the 1970's has become an international sport of major proportions and is considered to be the fastest growing water sport in the world. Sailboards are used in conditions ranging from a slight breeze on a calm lake to gale force winds in rough ocean surf.

A sailboard usually consists of a substantially flat, elongated board, a sail system, an optional centerboard system, and a fixed fin mounted aft. Much of the design of the sailboard has been borrowed directly from surfboards, including the fixed fin.

A component originaly designed for surfing that is used almost universally on sailboards is the adjustable fin holder. The adjustable fin holder allows longitudinal adjustment of the fixed fin's position while the board is out of water, as well as easy installation and removal of the fin.

Because of the versatility and shallow drafts of sailboards, these craft are often sailed in areas where the aft mounted fin will come into contact with an underwater obstruction, such as rock, reef, underwater debris, or the bottom of the sailing area. Damage due to the fin striking an underwater object may result in the following:

1. Breaking of the fin

2. Breaking of the fin holder box
3. Delamination of the fin holder from the board structure
4. Any combination of the above Replacement or repair of the damage described above is in most cases very costly. It is therefore highly desirable to fasten the fin to the fin holder in such a manner as to protect the fin and more expensive fin fastening components from damaging overloads.

SUMMARY OF THE INVENTION

The present invention provides a method of securely mounting a fin to an adjustable fin holder while also providing a means of stress relief to the fin, fin holder, and board structure in the event that the fin experiences physical impact from striking an underwater obstruction. The invention can be used on any sail or surfboard which has the conventional adjustable finholder, described below.

The fin holder used with the invention consists of a rectangular shaped channel which opens flush with the bottom surface of the sailboard. A fin having a longitudinal base member fits into the open channel of the fin holder.

The fit is laterally snug, so that the parallel sides of the fin holder's channel support the parallel sides of the fin base against sidewise loads, which are the principal water loads on the fin. In the fore-and-aft direction, the channel is commonly more than twice as long as the base of the fin, allowing the fin to take a range of longitudinal positions.

The fin holder has two longitudinal grooves running its length, between the bottom of the channel and the open top. ("Top" and "bottom" refer here to the board when upside down for storage or to be worked on. When the board is in use, the closed bottom of the channel is above its open top.) The fin is secured against being pulled out of the channel at the front and rear of its base member by use of the longitudinal grooves in the fin holder. The securing means, described below, serve also to resist the relatively small water drag on the fin.

The rear of the longitudinal base member of the fin contains a permanently fixed pin mounted perpendicularly to the plane of the fin and base member. This pin is inserted upon initial installation of the fin to the fin holder into the longitudinal grooves of the fin holder, thus securing the rear section of the fin against being pulled vertically out of the channel.

The longitudinal grooves in the fin holder also house a threaded sliding member into which a bolt passing through the forward end of the base member of the fin is screwed. This secures the forward section of the fin against being pulled out, at the same time resisting longitudinal loads by a clamping action.

The slide member which secures the forward section of the fin to the fin holder is to be made of materials which will suffer catastrophic breakage in the event that these components experience sudden severe loads, as would be the case in the event that the fin of the sailboard strikes an underwater obstruction. Upon the breaking of the slide member, the forward end of the fin base will release from the fin holder while pivoting on the pin at the rear of the fin base, the latter still being held within the longitudinal grooves of the fin holder.

The release mechanism described will greatly reduce the risk of fin breakage, fin holder breakage, and delamination of the fin holder from the board structure. Only a small part will have been broken, one for which replacements are easily kept ready and installed. An event which with present equipment could have ended sailing for the day or week is thus reduced to a brief and inexpensive interruption.

BRIEF DESCRIPTION OF THE DRAWINGS

FIG. 6 is an isometric view of a slide member weakened by scoring. FIG. 7 is a cross section through the center of a slide member to which a threaded metal nut is fixed.

DESCRIPTION OF THE PREFERRED EMBODIMENT

Figure 1:
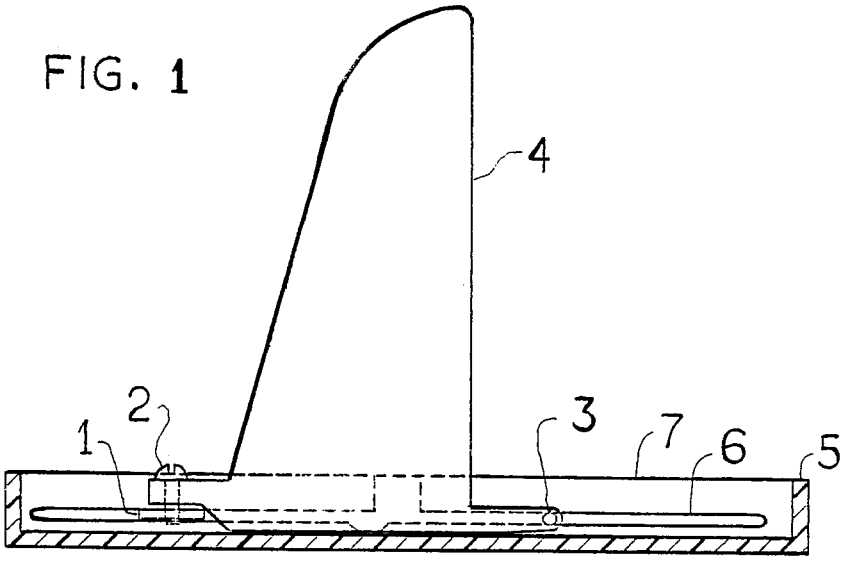
FIG. 1 is a side view of the fin holder with fin inserted and and secured. Fin and holder are shown inverted, as they would be upon installation of the fin in a sailboard which is ashore and upside down.

Referring to FIG. 1 the fin 4 shown inserted into a grooved finbox 5 is of typical configuration for a surfboard or sail-board.

Figure 2:
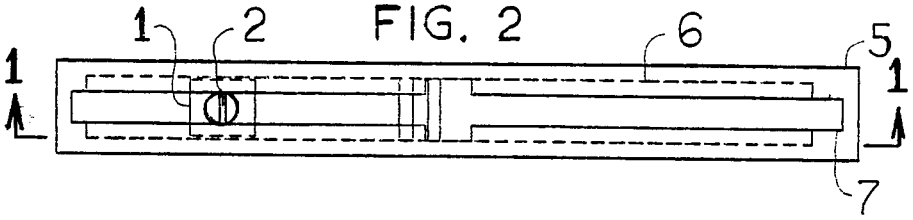
FIG. 2 is a plan view of the fin holder assembly with the breakable threaded slide member installed into the longitudinal grooves of the fin box, looking down at the bottom of the board.

The fin holder 5 FIGS. 1, 2 has two longitudinal grooves 6 running its length, between the bottom of its channel and the open top 7. The grooves serve to retain flat member 1 FIGS. 1, 2, 3, 4 so that it can slide forward and aft, but cannot escape from the fin holder except by way of vertical grooves 8.

Grooves 6 also retain pin 3 FIG. 1 by its ends, which project from the sides of the after end of the base of fin 4. The ends of pin 3 likewise enter grooves 6 by way of grooves 8 as fin 4 is inserted into fin holder 5. Pin 3 thus secures the after end of fin 4 to fin holder 5, while still allowing fin 4 to slide longitudinally and to rotate about pin 3.

Figure 3:
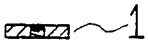
FIGS. 3 and 4 are side and plan views of the breakable slide member used for fastening the fin to the fin holder.
Figure 4:
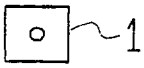
Figure 5:
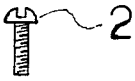
FIG. 5 shows the bolt used for fastening the fin to the slidable member.

Bolt 2 FIGS. 1, 2, 3, when passed through the vertical hole in the forward end of fin 4, screwed into threaded flat member 1 and tightened, pulls flat member 1 up against the upper surfaces of grooves 6 and clamps fin 4 down against the bottom of channel 7, thus holding fin 4 to fin holder 5 rigidly and in whatever longitudinal position is desired.

My invention provides that flat member 1 be the weakest part of the fin holding system, and that it preferably be brittle as well, so that when overloaded by impact of fin 4 with and underwater obstruction it will fail suddenly and completely. Then it can be replaced easily and at small cost in money and time.

Figure 6:
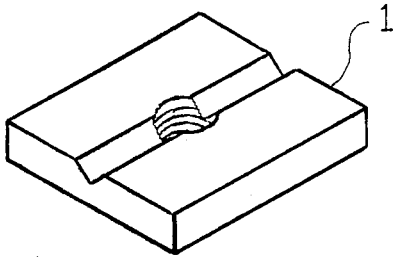
FIGS. 6 and 7 show modified forms of the breakable slide member.

FIG. 6 discloses flat plate 1 scored with a sharp groove to cause it to break along the score.

Figure 7:
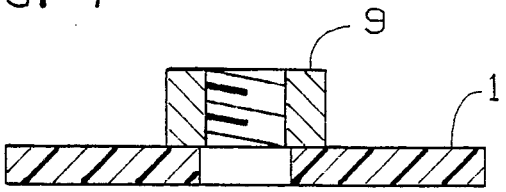

FIG. 7 discloses a nut 9 attached to the flat plate 1. The threaded hole of the nut 9 is vertical and is adapted to engage the bolt 2. In one embodiment the weakest part of the flat plate 1 is the point of attachment of the nut 9 to the flat 1. In another embodiment the nut forms a knife-like edge on which the flat plate 1 will break under overload.

Flat member 1 could also be made of a flexible material,thus allowing the flat member to become deformed and allowing its release from the longitudinal grooves of the fin holder in the event that the fin 4 is overloaded by impact.

The breaking of flat member 1 allows fin 4 to pivot on pin 3, pin3 still being retained by grooves6, thus allowing fin 4 to move in an arc-like manner rearward. The release of the fin from the fin holder as just described will greatly reduce the chance of damage to the fin, fin holder, and delamination of the finholder from the board structure in the event that the fin suffers physical impact from the striking of an underwater obstruction.

It should be noted that my invention is the opposite of present practice, in which flat member 1 is a stainless steel plate and appears to be, judging by the results of repeated accidents, the strongest and most tenacious part of the finholding system. As a rule, either the forward end of the fin breaks at bolt 2, or fin holder 5 is damaged or pulled loose from the board. That is, the most expensive parts fail, not the cheapest.

Having described my invention I now claim:

1. Means for securing a fin to the bottom of a sailboard in a range of longitudinal positions so as to allow release of the fin upon impact with an underwater obstruction for preventing damage to the fin, sailboard, and integral parts thereof, comprising:

a fin having a rectangular longitudinal base member, said base member having a vertical hole in the forward end thereof for accepting a bolt, and a pin mounted therethrough near the rear end thereof and perpendicular to the plane of said fin and said base member, a fin holder built into said sailboard and comprising a rectangular channel member having parallel opposing longitudinal sides for recieving said base member of said fin for being secured to the bottom of the sailboard, a pair of opposing longitudinal grooves, one in each said opposing side of said rectangular channel member, said grooves being of such dimensions as to accept the ends of said pin which project from the sides of said base member, thereby retaining said rear end of said base member in said channel member but leaving said base of said fin free to rotate about said pin, and a flat member of such dimensions as to fit slidably within and be retained by said grooves, said flat member being adapted to being pulled by said bolt, said bolt being first passed through said vertical hole in said fin base, thereby securing said fin base member to said channel member by clamping said flat member against the upper surfaces of said grooves in the sides of said channel member, wherein said flat member is of inferior strength compared to the other said members, such that an aftward blow to said fin will cause said flat member to fail first, without damage to other said members.

2. The fin securing means recited in claim 1, wherein said flat member is a substantially flat plate made of brittle material with vertical threaded hole therethrough, adapted to engage said bolt.

3. The fin securing means recited in claim 2, wherein said substantially flat plate is scored with a sharp groove to cause it to break along said score.

4. The fin securing means recited in claim 1,wherein said flat member is a substantially flat plate made of flexible material with vertical threaded hole therethrough, such that the flat member will deform and release from the longitudinal grooves of the adjustable fin holder in the event of an overload condition.

5. The fin securing means recited in claim 1, wherein said flat member is a substantially flat plate with a nut attached thereto with the threaded hole of said nut vertical and adapted to engage said bolt.

6. The fin securing means recited in claim 5, wherein the weakest part of said flat member is the attachment of said nut to said substantially flat plate.

7. The fin securing means recited in claim 5, wherein the said nut forms a knife-like edge on which said substantially flat plate will break under overload.

8. In an adjustable fin holder for securing a fin to a sailboard or surfboard by clamping said fin to said board by pulling on a flat member, said flat member being retained in said board by a pair of grooves in the sides of a slot in the bottom of said board, the improvement which comprises making said flat member no stronger than necessary to sustain the ordinary loads to which it is subjected, while leaving all parts of said fin and said board somewhat stronger than necessary to sustain ordinary loads, so that overloads resulting from an aftward blow to said fin will break said flat member, while leaving said fin and said board undamaged.

* * * * *